United States Patent [19]

Finch

[11] 4,222,862

[45] * Sep. 16, 1980

[54] FLOTATION OF OXIDIZED COAL WITH A LATEX EMULSION OF SODIUM POLYACRYLATE USED AS A PROMOTER

[75] Inventor: Robert E. Finch, Naperville, Ill.

[73] Assignee: Nalco Chemical Company, Oakbrook, Ill.

[ * ] Notice: The portion of the term of this patent subsequent to Jul. 31, 1996, has been disclaimed.

[21] Appl. No.: 949,327

[22] Filed: Oct. 6, 1978

Related U.S. Application Data

[63] Continuation-in-part of Ser. No. 807,770, Jun. 20, 1977, abandoned.

[51] Int. Cl.[2] ..... B03D 1/02

[52] U.S. Cl. ..... 209/166

[58] Field of Search ..... 209/319, 166, 167

[56] References Cited

U.S. PATENT DOCUMENTS

| | | | |
|---|---|---|---|
| 3,284,393 | 11/1966 | Vanderhoff | 526/911 X |
| 3,493,501 | 2/1970 | Eck | 210/54 R |
| 3,624,019 | 11/1971 | Anderson | 260/29.6 H |
| 3,734,803 | 5/1973 | Anderson | 260/29.6 H |
| 3,826,771 | 7/1974 | Anderson | 260/29.6 H |
| 3,856,618 | 12/1974 | Shubert | 209/5 |
| 3,919,080 | 11/1975 | Stauter | 209/167 |
| 3,997,492 | 12/1976 | Kane | 260/29.6 HH |
| 4,024,216 | 5/1977 | Finch | 210/54 A |
| 4,077,930 | 3/1978 | Lim | 260/29.6 H |

FOREIGN PATENT DOCUMENTS

| | | | |
|---|---|---|---|
| 1002702 | 2/1957 | Fed. Rep. of Germany | 209/166 |
| 1006442 | 9/1959 | Fed. Rep. of Germany | 209/166 |
| 703922 | 2/1931 | France | 209/166 |
| 903853 | 8/1962 | United Kingdom | 209/5 |
| 121385 | 6/1958 | U.S.S.R. | 252/61 |

OTHER PUBLICATIONS

Chem. & Tech. of Coal, Agroskin, Published for U.S. Dept. of Int. & NSF by Israel Program for Sci. Translations, 1966, pp. 33–43.

*Primary Examiner*—Robert Halper

*Attorney, Agent, or Firm*—John G. Premo; John S. Roberts; Robert A. Miller

[57] ABSTRACT

A method and treating agent for increasing the yield of oxidized coal or coal from surface or strip mines where said coal particles are concentrated by froth flotation. The method consists of utilizing as a promoter or frothing aid about 0.05–1.5 lbs of sodium polyacrylate latex per ton of dry coal (0.017–0.5 lb of dry sodium polyacrylate per ton of dry coal), having an average molecular weight of about 100,000 to 1,000,000 and more, with a preferred range of 1,000,000 or more.

The preferred promoter or frothing aid for oxidized coal is a water-in-oil latex of sodium polyacrylate and preferably used with an alcohol-type frother. The latex may be utilized neat and self inverts with the assistance of an oil-in-water surfactant hydrophilic (or activator) and the water in the system upon application to form an oil-in-water emulsion, or it may be used as a two-part system with an activator (aqueous) to promote inversion. The latex emulsion has demonstrated superiority as a flotation promoter for oxidized coal over the dry polymer and exhibits synergism over the dry polymer and over the components of the latex emulsion including a paraffin solvent, a hydrophobic emulsifier such as sorbitan monooleate, a solvent such as Espersol 3-E (Charter; an aromatic blend) and stabilizers such as polyisobutylene and aluminum tristearate.

5 Claims, No Drawings

FLOTATION OF OXIDIZED COAL WITH A LATEX EMULSION OF SODIUM POLYACRYLATE USED AS A PROMOTER

This application is a continuation-in-part of pending Ser. No. 807,770 filed June 20, 1977, now abandoned of Robert E. Finch.

The present invention relates to a method of inreasing the yield of oxidized coal where said coal or coal particles are subjected to concentrations by froth flotation.

Coal generally is mined in this country and elsewhere from two different sources. A first source of great importance to retrieval of coal presently is coal mined from so-called strip mines where the coal is near or at the surface of the ground and the veins are stripped therefrom. During this stripping process and before the coal is actually retrieved, the surface veins of coal are subjected to a significant amount of air oxidation which apparently changes the characteristics of the particles so that the results obtained in a concentration by froth flotation are different from concentration of the coal from the other source which is mined underground generally at a depth of greater than 100 feet from the surface and where there is less oxidation as in the underground mines of Pennsylvania and West Virginia.

The term "oxidized coal" in the present invention is defined as any type of weathered coal such as strip-mined coal or native or deep mined coal in which there has been a 1% or greater increase in oxygen content due to weathering, stockpiling, long storage times, etc. The different degrees of weathering in coal seams as to oxygen content is highly variable and the following analysis is taken from Karaganda coals (Russian) and is cited from A. A. Agroskin, *Chemistry and Technology of Coal,* 1961, page 33, translated by the Israel Program for Scientific Translations 1966:

| | |
|---|---|
| Carbon | 77.9–88.3% |
| Hydrogen | 4.2–5.7% |
| Nitrogen | 1.0–1.7% |
| Oxygen | 5.2–16.2% |

The deleterious effect of an increase of oxygen in coal has been noted by several authors, e.g., S. C. Sun, *Coal Preparation,* "Part 3. Froth Flotation," page 10–67, "The unfloatability of oxygen and mineral matter is indicated by the nonfloatable lignite and animal charcoal. The deleterious effect of oxygen on the floatability of coals and coke has been described . . . "

It is further noted that coal is readily oxidized in air and this process sometimes even gives rise to spontaneous combustion in the coal and results in weathering or loss of calorific value and coking power during storage in the open.

As is known, flotation is a process for separating finely ground minerals such as coal particles from their associate waste or gangue by means of the affinity of surfaces of these particles for air bubbles, which is a method for concentrating coal particles. In the flotation process a hydrophobic coating is placed on the particles which acts as a bridge so that the particles may attach to the air bubble and be floated, since the air bubble will not normally adhere to a clean mineral surface such as coal.

In froth flotation of coal a froth is formed as aforesaid by introducing air into a so-called pulp which contains the impure finely divided coal particles and water containing a frothing agent. The flotation separation of coal from the residue or gangue depends upon the relative wettability of surfaces and the contact angle, which is the angle created by the solid air bubble interface.

In the development of flotation to date, three general classes of reagents have been utilized: (1) collectors or promotors, (2) modifiers, and (3) frothers.

The collectors may be selected from such compounds,among others, as primary amines, quaternary ammonium salts, xanthates, fatty acid soaps, kerosene, fuel oil, alkyl sulfates, etc. A typical listing of commercial collectors is given in Kirk-Othmer, *Encyclopedia of Chemical Technology,* II, Vol 9, page 384, Table 2.

Modifiers are such regulating agents as pH regulators, activators, depressants, dispersants, and flocculants.

A frothing agent is utilized to provide a stable flotation froth persistent enough to facilitate the coal separation but not so persistent that is cannot be broken to allow subsequent handling. Examples of commonly used frothing agents are pine oil, creosote, cresylic acid, and alcohols such as 4-methyl-2-pentanol. Alcohol frothers are preferred in the present invention and additional alcohols are illustrated by amyl and butyl alcohols, terpeneol and cresols. An additional preferred alcohol is methyl isobutylcarbinol (MIBC), which is an aliphatic alcohol in common use as a frother.

The present treating agents which are water-soluble polyacrylates are useful as promoters and frothing aids.

PRIOR ART STATEMENT

A. Utilization of water-soluble polymers

U.S. Pat. No. 2,740,522 Aimone et al—The patentee utilizes water-soluble polymers in amounts 0.001 lbs/ton to 1.0 lbs/ton with a preferred amount of 0.01 lbs/ton to 0.2 lbs/ton. Example 16 (column 7) shows the flotation of Pennsylvania anthracite coal fines conditioned with 0.2 lbs/ton of the sodium salt of hydrolyzed polyacrylonitrile to produce a rougher concentrate. A second portion of the example utilizes 0.5 lbs/ton of polymer. This patent appears equivalent to British Pat. No. 749,213.

B. Concentration of coal by flotation

U.S. Pat. No. 3,696,923 Miller

In the above prior art, none of the patents noted dealt with the problems envisaged with the attempts to use flotation concentration on oxidized coal.

It was found that in attempting to float oxidized coal there were serious problems of flooding, stoppages of equipment, and unsatisfactory yield and this was true where a majority blend of deep mine coal was mixed with strip coal where 80% deep mine coal was utilized in the mixture.

THE TREATING AGENT

The treating agent for the present invention may be defined as a promoter or frothing agent which is a latex or water-in-oil emulsion of a water-soluble anionic linear addition polymer of a polymerizable monoethylinically unsaturated compound having an average molecular weight of about 100,000 to 1,000,000 and more, with a preferred molecular weight of about 1,000,000 or more.

A specially preferred promoter or frothing aid is sodium polyacrylate. The dosage of this latter treating agent is in the range of 0.05–1.5 lbs. of sodium polyacrylate latex per ton of dry coal (0.017–0.5 lb. of dry sodium polyacrylate per ton of dry coal) and it is utilized conventionally as a 0.5–2% solution. Utilization has resulted in a 64.6% coal recovery as opposed to 16.4% recovery when using the dry polymer precipitate of sodium polyacrylate. It is noted in comparing Examples 1 and 2, post, that the recovery percent for polyacrylate utilized in emulsion form was 64.6% as compared with a lower form for sodium polyacrylate utilized in solution form of 20–30%.

Also operable in the present invention, together with the anionic sodium polyacrylate, are minor percentages of non-anionic polyacrylamide in the form of a mixture or copolymer wherein the percentile of polyacrylamide is up to 25% of the total. Such addition of polyacrylamide does not modify the basic anionic character of the polymer, which is a necessary criteria.

Oxidized coal recovery utilizing sodium polyacrylate latex emulsion (oil-in-water) is shown in Table 1.

TABLE 1

Oxidized Coal Flotation Using Latex Polymers

| | Promoter | Dosage (lbs/tons) Effective | Equivalent to Latex | % Coal Recovery |
|---|---|---|---|---|
| (1) | Sodium polyacrylate latex emulsion | 0.3 | 0.3 | 64.6 |
| (2) | Sodium polyacrylate dry | 0.1 | 0.3 | 16.4 |
| (2a) | Sodium polyacrylate dry | 1.0 | 3.0 | 36.6 |
| (3) | Azo-bis-isobutyro-nitrile | 0.006 | 0.3 | 37.3 |
| (3a) | Azo-bis-isobutyro-nitrile | 0.06 | 3.0 | 34.5 |
| (4) | Sorbitan monooleate (SPAN 80, ICI) | 0.0066 | 0.3 | 20.1 |
| (4a) | Sorbitan monooleate (SPAN 80, ICI) | 0.066 | 3.0 | 32.2 |

In Table 1 above, Promoter No. 1 showed 64.6% coal recovery. Promoter No. 1, a water-in-oil emulsion of sodium polyacrylate was prepared utilizing water, sodium acrylate, ingredients 3 and 4, and an isoparaffinic solvent as principal ingredients. The individual effect of the dry precipitate 2 at 16.4 and 36.6, depending on concentration, are also given. The individual effect of the azo initiator and the emulsifier (SPAN 80) are set out.

TABLE 2

Comparative Activity of the Promoter with Latex Polymers

| Run No. | Frother | Dosage (lb/ton) | Promoter | Dosage (lb/ton) | % Recovery* |
|---|---|---|---|---|---|
| 1 | MIBC** | 0.2 | LOPS⊕ | 0 | 0 |
| 2 | MIBC** | 0.2 | LOPS⊕ | 0.11 | 2.6 |
| 3 | MIBC** | 0.2 | LOPS⊕ | 0.27 | 3.0 |
| 4 | MIBC** | 0.2 | LOPS⊕ | 0.48 | 6.3 |
| 5 | MIBC** | 0.2 | LOPS⊕ | 0.74 | 10.6 |
| 6 | MIBC** | 0.2 | #2 Fuel Oil | 0.80 | 44.9 |
| 7 | MIBC** | 0.2 | #2 Fuel Oil | 0.50 | 18.7 |
| 8 | MIBC** | 0.2 | #2 Fuel Oil | 0.30 | 7.0 |
| 9 | MIBC** | 0.2 | Latex Polymer A2 | 0.20 | 10.7 |
| 10 | MIBC** | 0.2 | Latex Polymer A2 | 0.30 | 15.1 |
| 11 | MIBC** | 0.2 | Latex Polymer A2 | 0.40 | 18.0 |
| 12 | MIBC** | 0.2 | Latex Polymer 2 | 0.30 | 40.9 |

TABLE 2-continued

Comparative Activity of the Promoter with Latex Polymers

| Run No. | Frother | Dosage (lb/ton) | Promoter | Dosage (lb/ton) | % Recovery* |
|---|---|---|---|---|---|
| | | | & Fuel Oil | 0.50 | |

*% Recovery is on total solids, not actual coal in float
**Methyl isobutylcarbinol
⊕Low ordor paraffin solvent
Coal: Oxidized coal from King Powellton Coal Company
Polymer A2 is derived from monomer starting material A at page 8 post.

It is noted that, with reference to Runs 2 (utilizing LOPS) and 11 (utilizing the latex emulsion polymer) and considering that the amount of LOPS in the starting material is in the range 20–30%, the activity indicated in the percent recovery of coal shows a distinct increase of from 2.6 to 18.0. Again, with reference to Runs 3 and 8, the results for percent recovery would indicate that there is a similar activity in the use of LOPS and #2 fuel oil.

THE LATEX

The preparation of the water-in-oil latex from monomers, its polymerization to a water-in-oil emulsion, and its subsequent inversion to an oil-in-water emulsion in use are described in one or more of the following patents:

U.S. Pat. No. 3,997,429 Kane et al;
U.S. Pat. No. 3,624,019 Anderson et al;
U.S. Pat. No. 3,734,873 Anderson et al;
U.S. Pat. No. 3,826,771 Anderson et al.

A monomer starting material useful for frothing oxidized coal has a composition as follows:

| | |
|---|---|
| Water | 27.0 |
| Caustic soda (50%) | 23.0 |
| Acid acrylic glacial | 20.9 |
| Low odor paraffin solvent (LOPS) | 19.3 |
| Sorbitan monooleate (SPAN 80, ICI) | 1.0 |
| Azo-bis-isobutyronitrile (catalyst) | 0.03 |
| Espesol 3-E (a liquid aromatic hydrocarbon blend, Charter International) | 8.5 |
| Polyisobutylene (stabilizer) | 0.27 |
| Aluminum tristearate (stabilizer) | 0.0002 |

The polymerized sodium polyacrylate may be produced by polymerization of, for example, the above recipe according to the teachings of U.S. Pat. No. 3,284,393 Vanderhoff et al using a free radical type catalyst.

A most preferred polymeric emulsion useful in the present invention is the following:

| | | % by Wt of Emulsion |
|---|---|---|
| (1) | Polymer (Na/K polyacrylate) | 33.0 |
| (2) | Oil (paraffinic hydrocarbon liquid) | 21.7 |
| (3) | Water | 43.8 |
| (4) | Emulsifier (water-in-oil) | 1.5 |
| | | 100.0 |

A typical preferred water-in-oil polymeric emulsion contains:

| | | |
|---|---|---|
| (1) | Polymer | 10–52.8% (alkali metal polyacrylate) |
| (2) | Oil | 18–32% (paraffinic hydrocarbon liquid) |
| (3) | Water | 67–15% |
| (4) | Emulsifier | 5–0.1% (water-in-oil emulsifier) |

Specific examples illustrating broad stable and operable compositions are set out below. These examples illustrate oil values which are operable but beyond the ordinary commercial range.

| | I | II | III | IV |
|---|---|---|---|---|
| Polymer | 40 | 50 | 10 | 10 |
| Oil | 40 | 5 | 15 | 50 |
| Water | 20 | 45 | 75 | 40 |
| Water-in-oil Emulsifier (Span 80) | 2 | 1.4 | .9 | .6 |
| Intrinsic Viscosity | 13 | 13 | | |

Where a high polymer composition is utilized as in I and II above, potassium acrylate is used in the polymer formulation for solubility reasons.

The above-noted compositions are not self inverting but a variety of inverting techniques are set out in U.S. Pat. No. 3,624,019 at column 3, lines 49–57. The presence of any of a group of activators will cause the polymer emulsion to self invert. Such activators may be selected from:

(1) Surfonic N-95 (Jefferson Chemical Co.), a nonylphenol with 10 moles of ethylene oxide;
(2) Triton N-101 (Rohm & Haas), nonylphenoxy polyethoxyethanol;
(3) Makon 10 (Stepan Chemical Co.), alkyl phenoxy polyoxyethylene ethanol;
(4) Igepal CO 630 (GAF), nonylphenoxy poly(ethyleneoxy)ethanol.

In the present case the activator may be placed in a separate vehicle with water. Alternatively, an activator may be added later to the polymerized composition for a self invert mode. An explanation of the action of the inversion technique is that a normal latex will generally be added to water containing a hydrophilic surfactant, as, for example, Surfonic N-95, thereby causing the emulsion to invert and allowing the polymer previously in the discontinuous phase to wind up in the continuous phase of the water-in-oil emulsion. This, of course, allows the polymer to solubilize. For self-inverting emulsions, the same original emulsion is carefully balanced so that, when added to water, the emulsion inverts, thereby allowing the polymer to solubilize.

THE HYDROPHOBIC LIQUIDS

The hydrophobic liquids or oils used in preparing these emulsions may be selected from a large group of organic liquids which include liquid hydrocarbons and substituted liquid hydrocarbons.

A preferred group of organic liquids that can be utilized in the practice of this invention are paraffinic hydrocarbon oils. Examples of these types of materials include a branch-chain isoparaffinic solvent sold by Humble Oil and Refinery Company under the tradename "Isopar M" described in U.S. Pat. No. 3,624,019 and a paraffinic solvent sold by the Exxon Company, U.S.A. called "Low Odor Paraffinic Solvent." Typical specifications of this material are set forth below in Table 3.

TABLE 3

| | |
|---|---|
| Specific Gravity 60°/60° F. | 0.780–0.806 |
| Color, Saybolt | + 30 min. |
| Appearance, visual | Bright and Clear |
| Aniline Point, °F., ASTM D-611 | 160 min. |
| Distillation, °F., ASTM D-86 | |
| IBP | 365 min. |
| FBP | 505 max. |
| Flash Point, °F., TCC | 140 min. |
| Sulfur, ppm, Microcoulometer | 15 max. |

While paraffinic oils are the preferred materials for use in preparing the water-in-oil emulsions of this invention, other organic liquids can be utilized. Thus, mineral oils, kerosenes, naphthas, and in certain instances petroleum may be used. While useful in this invention, solvents such as benezene, xylene, toluene, and other water immiscible hydrocarbons having low flash points or toxic properties are generally avoided due to problems associated with their handling.

THE WATER-IN-OIL EMULSIFYING AGENTS

Any conventional water-in-oil emulsifying agent can be used such as sorbitan monostearate, sorbitan monooleate, and the so-called low HLB materials which are all documented in the literature and are summarized in the Atlas HLB Surfactants Selector. Although the mentioned emulsifiers are used in producing good water-in-oil emulsions, other surfactants may be used as long as they are capable of producing these emulsions. It is also contemplated, however, that other water-in-oil emulsifying agents can be utilized.

U.S. Pat. No. 3,997,492 shows the use of emulsifiers generally having higher HLB values to produce stable emulsions similar in character to those discussed above. With the use of the equations present in this reference, which is hereinafter incorporated by reference, emulsifiers having HLB values between 4–9 can be utilized in the practice of this invention.

In addition to the reference described above, U.S. Pat. No. 4,024,097 discloses particular emulsifying agents for the water-in-oil emulsions, which are the subject of this invention. These emulsions are generally prepared according to this reference utilizing a water-in-oil emulsifying agent comprising a partially esterified lower N,N-dialkanol substituted fatty amide. Additionally, other surfactants may be combined to produce emulsions having small particle sizes and excellent storage stability.

THE PREPARATION OF THE WATER-IN-OIL EMULSIONS OF WATER SOLUBLE VINYL ADDITION POLYMERS

The general method for the preparation of emulsions of the type described above is contained in Vanderhoff, U.S. Pat. No. 3,284,393, which is hereinafter incorporated by reference. A typical procedure for preparing water-in-oil emulsions of this type includes preparing an aqueous solution of a water soluble vinyl addition monomer and adding this solution to one of the hydrocarbon oils described above. With the addition of a suitable water-in-oil emulsifying agent and under agitation, the emulsion is then subjected to free radical polymerization conditions and a water-in-oil emulsion of the water soluble vinyl addition polymer is obtained. It should be pointed out that the ingredients are chosen based upon the weight percentages given above and their compatability with each other. As to choice of free radical catalyst, these materials may be either oil or water soluble and may be from the group consisting of organic peroxides, Vazo type materials, red-ox type initiator systems, etc. Additionally, ultraviolet light, microwaves, etc. will also cause the polymerization of water-in-oil emulsions of this type.

In the manufacture of emulsions of this type, which are further detailed in U.S. Pat. No. 3,624,019, U.S. Pat. No. 28,474, U.S. Pat. No. 3,734,873, U.S. Pat. No. Re. 28,576, U.S. Pat. No. 3,826,771, all of which are hereinafter incorporated by reference, the use of air may be employed to control polymerization. This technique is described in U.S. Pat. No. 3,767,629 which is also hereinafter incorporated by reference.

In addition to the above references, U.S. Pat. No. 3,996,180 describes the preparation of water-in-oil emulsions of the types utilized in this invention by first forming an emulsion containing small particle size droplets between the oil, water, monomer and water-in-oil emulsifying agent utilizing a high shear mixing technique followed by subjecting this emulsion to free radical polymerization conditions. Also of interest is U.S. Pat. No. 4,024,097 which describes water-in-oil emulsions such as those described above utilizing particular surfactant systems for the water-in-oil emulsifying agent, allowing for the preparation of latexes having small polymer particle sizes and improved storage stability.

Another reference, U.S. Pat. No. 3,915,920, discloses stabilizing water-in-oil emulsions of the type above described utilizing various oil-soluble polymers such as polyisobutylene. Employment of techniques of this type provides for superior stabilized emulsions.

Of still further interest is U.S. Pat. No. 3,997,492 which describes the formation of water-in-oil emulsions of the type above described utilizing emulsifiers having HLB values of between 4–9.

PHYSICAL PROPERTIES OF THE WATER-IN-OIL EMULSIONS

The water-in-oil emulsions of the finely divided water-soluble polymers useful in this invention contain relatively large amounts of polymer. The polymers dispersed in the emulsion are quite stable when the particle size of the polymer is from the range of 0.1 microns up to about 5 microns. The preferred particle size is generally within the range of 0.2 microns to about 3 microns. A most preferred particle size is generally within the range of 0.2 to 2.0 microns.

The emulsions prepared having the above composition generally have a viscosity in the range of from 50 to 1000 cps. It will be seen, however, that the viscosity of these emulsions can be affected greatly by increasing or decreasing the polymer content, oil content, or water content as well as the choice of a suitable water-in-oil emulsifier.

Another factor attributing to the viscosity of these types of emulsions is the particle size of the polymer which is dispersed in the discontinuous aqueous phase. Generally, the smaller the particle obtained the less viscous the emulsion. At any rate, it will be readily apparent to those skilled in the art as to how the viscosity of these types of materials can be altered. It will be seen that all that is important in this invention is the fact that the emulsion be somewhat fluid, ie: pumpable.

THE INVERSION OF THE WATER-IN-OIL EMULSIONS OF THE WATER SOLUBLE VINYL ADDITION POLYMERS

The water-in-oil emulsions of the water-soluble polymers discussed above have unique ability to rapidly invert when added to aqueous solution in the presence of an inverting agent or physical stress. Upon inversion, the emulsion releases the polymer into water in a very short period of time when compared to the length of time required to dissolve a solid form of the polymer. This inversion technique is described in U.S. Pat. No. 3,624,019, hereinafter incorporated by reference. As stated in the Anderson reference, the polymer-containing emulsions may be inverted by any number of means. The most convenient means resides in the use of a surfactant added to either the polymer-containing emulsion or the water into which it is to be placed. The placement of a surfactant into the water causes the emulsion to rapidly invert and release the polymer in the form of an aqueous solution. When this technique is used to invert the polymer-containing emulsion the amount of surfactant present in the water may vary over a range of 0.01 to 50 percent based on the polymer. Good inversion often occurs within the range of 1.0–10 percent based on polymer.

The preferred surfactants utilized to cause the inversion of the water-in-oil emulsion of this invention when the emulsion is added to water are hydrophilic and are further characterized as being water soluble. Any hydrophilic type surfactant such as ethoxylated nonyl phenols, ethoxylated nonyl phenol formaldehyde resins, dioctyl esters of sodium succinate and octyl phenol polyethoxy ethanols, etc. can be used. Preferred surfactants are generally nonyl phenols which have been ethoxylated with between 8–15 moles of ethylene oxide. A more complete list of surfactants used to invert the emulsion is found in Anderson, U.S. Pat. No. 3,624,019 at columns 4 and 5.

EXAMPLE 1

A sodium polyacrylate latex emulsion was fed into the flotation cell feed carrying oxidized coal. The latex promoted the flotation of fine coal resulting in increased fine coal recovery up to and including 64% recovery rate. This sodium polyacrylate latex emulsion coal promoter thus proved effective in increasing recovery of oxidized coal. In use, dosage rates of the sodium polyacrylate latex emulsion varied from approximately 0.3–1.5 lbs of sodium polyacrylate latex per ton of dry coal fed to the flotation circuit. The latex was used in conjunction with a straight chain alcohol frother of the $C_6$–$C_{12}$ type. The alcohol frother dosage was approximately 0.15 lb/ton of dry coal feed. The frother was normally fed to the flotation cell head box.

EXAMPLE 2

Comparative, Using Polyacrylate Solution

In 1976 a coal flotation promoter evaluation was run using sodium polyacrylate at an eastern U.S. coal preparation plant. This plant processes both deep mine and oxidized strip mine coal. Due to the difficulty in efficiently floating oxidized coal in the frother support, this company must feed a blend of these coals in which the oxidized constituent makes up only 10–20% of the total input. Primary difficulty in processing oxidized coal is that in the froth banks the coarser portion of the oxidized size (probably 100×28 mesh) does not readily float and consequently, the majority of oxidized coal particles in the froth are very fine. When this froth is fed to vacuum disk filters, where the clean coal is recovered, the high proportion of oxidized, 0×100 mesh, coal particles blinds off the filters and reduces cake thickness and ultimate recovery. Further, this situation causes a significant increase in filter overflow, which is fed to a filter sump. Normally, when oxidized coal feed is increased to about 20% of the plant input for about an hour, the attendent reduction in vacuum filter efficiency causes the filter sump to become swamped to a point where it overflows onto the plant floor. This condition is further aggravated by the physical nature of the froth. When the oxidized coal feed is high, the float bubbles become large and extremely stable, resulting in a foamy mass having such integrity that it remains intact on the surface of the filtration tank. Ultimately it is discharged onto the plant floor when the filter sump overflows. In this situation, plant procedure is to reduce or shut down all oxidized coal until filter efficiency can be improved by running on a 90% to 100% deep mine input. Fairly often, the above-mentioned upset is so severe that total coal feed to the plant must be completely shut down until filter operation returns to normal.

A further difficulty is due to the low level of oxidized coal utilization; the plant depletes its deep mine coal stocks approximately every five or six hours. This requires the plant to shut down until sufficient deep mine coal is received for another five or six hour period of operation. This down time delay typically lasts from two to four hours.

Sodium polyacrylate was added to the slurry launder prior to the distribution box which feeds the nine flotation banks. The feed slurry of −28 mesh material came from a series of sieve bends which all discharge into the common launder. The sodium polyacrylate was added at a point of high turbulence. The treated feed slurry drops by gravity into the distribution box which also exhibits high turbulence.

CONCLUSIONS

Referring to Table 4, it is noted that set 2 versus set 1 indicates a 23.5% increase flotation solids recovery where the sodium polyacrylate was utilized at dosages of 0.075 to 0.088 lb/ton of coal. The procedure at the coal plant was to utilize a standard collector and frother and process line similar to that taught in U.S. Pat. No. 3,696,923 Miller. A subsequent comparison of set 5 against set 4 did not produce a difference in percent solids. However, the percent solid input in 4 is higher and the set 5 feed ash is greater than for set 4. It is noted that, in the operating procedure to obtain the results in sample set 5, these were taken after severe plant upsets had occurred where maximum float quality and filter efficiency could not be re-established. Additional examples not in the table showed that the increase in recovery of the float solids varies from about 20–30% or 23–30%.

TABLE 4

SUMMARY OF RESULTS ON COMPOSITE SAMPLES COLLECTED

| Sample Set | Frother Dosage | Sodium Polyacrylate Dosage | Feed % Solids | Feed % Coal | Feed % Ash | Float % Solids | Float % Coal | Float % Ash | Tails % Solids | Tails % Coal | Tails % Ash |
|---|---|---|---|---|---|---|---|---|---|---|---|
| No. 1 | 0.04 lbs/ton | — | 6.46 | 84.05 | 15.95 | 24.37 | 94.88 | 5.12 | 1.21 | 42.99 | 57.01 |
| No. 2 | 0.04 lbs/ton | 0.075–0.088 lbs/ton | 6.31 | 83.62 | 16.38 | 30.10 | 94.45 | 5.55 | 1.31 | 41.29 | 58.71 |
| No. 3 | Not used because of plant shut down | | | | | | | | | | |
| No. 4 | 0.12 lbs/ton | — | 7.81 | 84.87 | 15.13 | 25.89 | 94.18 | 5.82 | 1.35 | 44.00 | 56.00 |
| No. 5 | 0.10 lbs/ton | 0.032 | 6.26 | 83.23 | 16.77 | 23.99 | 93.21 | 6.79 | 1.17 | 35.66 | 64.34 |

I claim:

1. A method of increasing the yield of oxidized coal undergoing a concentration treatment of froth flotation by using as a flotation promoter in the presence of a hydrophilic activator to assist in inversion; an invertible water-in-oil emulsion, which is composed of a paraffinic liquid, a water-in-oil emulsifier, and sodium polyacrylate in a dosage calculated as 0.017–0.5 lb of dry sodium polyacrylate per ton of dry coal, said water-in-oil emulsion conforming to the following formula:

(1) 10–52.8% by wt. of the emulsion of an alkali metal polyacrylate
(2) 18–32% by wt. of the emulsion of a paraffinic liquid
(3) 67–15% by wt. of the emulsion of water
(4) 5–0.1% by wt. of the emulsion of a water-in-oil emulsifier.

2. The method according to claim 1 wherein the emulsion contains in weight percent:

(1) 33.0 sodium polyacrylate
(2) 21.7 paraffinic liquid
(3) 43.8 water
(4) 1.5 water-in-oil emulsifier.

3. The method of claim 1 wherein the water-in-oil sodium polyacrylate emulsion inverts on contact with water to an oil-in-water emulsion.

4. The method of claim 1 wherein an oil-in-water hydrophilic activator as inversion assistant is added separately.

5. The method according to claim 1 wherein the flotation promoter additionally contains a stabilizer selected from one member of the group consisting of toluene, xylene, polyisobutylene, and aluminum tristearate.

* * * * *